United States Patent [19]

Petersson

[11] 4,008,075

[45] Feb. 15, 1977

[54] AUTOGENOUS SMELTING OF LEAD IN A TOP BLOWN ROTARY CONVERTER

[75] Inventor: Stig Arvid Petersson, Vintergatan, Sweden

[73] Assignee: Boliden Aktiebolag, Stockholm, Sweden

[22] Filed: Dec. 12, 1974

[21] Appl. No.: 532,234

[30] Foreign Application Priority Data

Dec. 20, 1973 Sweden ..... 7317219

[52] U.S. Cl. ..... 75/77

[51] Int. Cl.[2] ..... C22B 13/00

[58] Field of Search ..... 75/77, 78; 266/37

[56] References Cited

UNITED STATES PATENTS

| | | | |
|---|---|---|---|
| 2,984,562 | 5/1961 | Kohlmeyer | 75/77 |
| 3,300,301 | 1/1967 | Malmstrom | 75/77 |
| 3,756,806 | 9/1973 | Hathorn | 75/93 R X |
| 3,847,595 | 11/1974 | Liang et al. | 75/77 |

OTHER PUBLICATIONS

Boldt, Jr. *Winning of Nickel* Van Nostrand Co. Inc., 1972 p. 252.

*Primary Examiner*—M. J. Andrews
*Attorney, Agent, or Firm*—Stevens, Davis, Miller & Mosher

[57] ABSTRACT

Processes are provided for the autogenous production of crude lead from sulphidic lead concentrates or complex sulphide materials containing lead. The processes are carried out in a rotary converter with the rotation axis inclined to the plane of the vertical. In the process the sulphidic materials are smelted and reduced while the converter is rotated.

11 Claims, 1 Drawing Figure

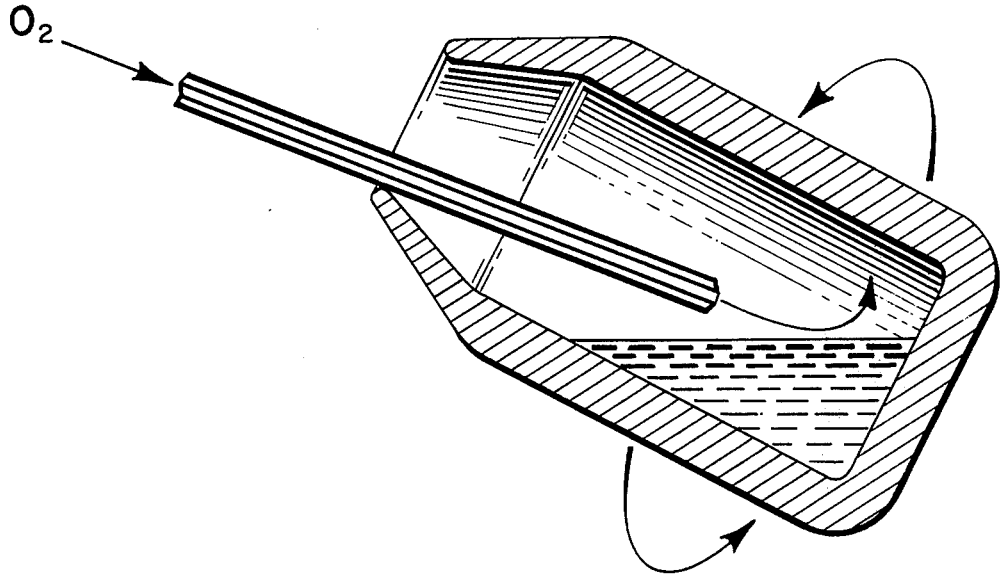
$O_2$

AUTOGENOUS SMELTING OF LEAD IN A TOP BLOWN ROTARY CONVERTER

The invention refers to a method of producing crude lead in a top blown rotary converter (TBRC or Kaldo converter) by the autogenous smelting and recovering of lead from sulphidic lead concentrates or complex sulphide material containing lead.

Metallic lead is normally produced from sulphidic concentrates and to a lesser extent from oxidic lead bearing raw materials. The most common type of furnace used for smelting and reducing lead-bearing materials is a shaft furnace. The shaft furnace is charged with lead materials which have been sintered in advance or roasted with the simultaneous oxidation of sulphidic sulphur by atmospheric oxygen to less than 2% sulphidic sulphur. Various methods of sintering and roasting sulphidic lead materials are described in e.g. Tafel, "Lehrbuch der Metallhuttenkunde", Volume II (1953), pp 35–73. These processes require expensive apparatus and the methods of sintering and roasting are themselves, in many cases, difficult to apply. During the roasting the lead is transformed mainly to an oxidic form. The material supplied must be rather coarse to be suitable for charging into a shaft furnace. The same applies to the slagging agent and the coke which are added and which are essential for heating and reducing the lead oxide. The roasting heat released in the combustion of the sulphidic sulphur contained by the material is thus largely lost. The function and working of the shaft furnace are described in Tafel, Volume II, pp 73–124. The production capacity of the shaft furnace is great but it has also the disadvantage that it requires the difficult and costly pre-treatment of the charge. Further, the heat economy of the shaft furnace process is poor and the apparatus requires a great deal of space.

Another type of furnace used for the production of lead is the reverbatory furnace which basically consists of a large hearth which can be fired by means of an air-fuel flame normally directed along or at a narrow angle to the surface of the bath. The reverbatory furnace is also charge with sintered agglomerated roasting material along with coke and a slagging agent. The heat economy of the reverbatory furnace is considered to be even poorer than that of the shaft furnace. Cf. Tafel, Volume II, p 124.

During recent years rotary furnaces have also come into use, especially the type that is short in relation to its diameter, known by its German name "Kurztrommelofen" (short drum rotary furnace), which rotates slowly during the course of the process at a speed of approx. 1 rpm. A rotary furnace, too, is charged with sintered and roasted lead sulphidic material, but the rotary furnace, like the reverbatory furnace, can work with a somewhat greater sulphur content in the charge by virtue of the reaction: $PbS + 2\ PbO \rightarrow 3\ Pb + SO_2$. As regards the working of the rotary furnace, see "Metall und Erz" 32 (1935) p 511 etc. The heat economy of the rotary furnace is superior to that of the reverbatory furnace and has therefore come to be of great importance in the working up of oxidic material such as accumulator scrap.

A method which has appeared in recent years is lead reduction in a rotating hearth. The method is described in Symp. Met. Lead and Zinc. p 960, 1970 Volume III and is based on the continuous charging of lead sulphide pellets into the rotating hearth which is in the shape of a closed horizontal ring, where metallic lead is released as in ordinary roasting reactions by blowing air through the lead bath, after which the roasting gases pass through the charge floating on the lead and sulphur dioxide is given off.

All of these processes, with the exception of the hearth described above, are based more or less on the fact that lead concentrates, before the reduction and recovery of the lead, must be pretreated to roast off most of the sulphur content and also that the roasted material must be sintered to a size suitable for treating in the processes. This means that most of the heat released in the roasting process cannot be put to use.

To improve heat economy processes have been developed where sulphidic and oxidic material is treaed in a tornado-like whirl or whirls created by blowing in reaction gas. The sulphidic and oxidic materials are carried into the whirl together with the reducing agent which reduces to the metallic state. See, for example, Swedish Pat. No. 213 084. If air is used as reaction gas sufficient heat is not generated to maintain the reaction temperature which is why additional heat in the form of electrical energy must be supplied. The method is not suitable for the autogenous smelting of lead sulphides even if oxygen gas or air strongly enriched with oxygen are used in the whirl since the gas transport pattern is not suitable to maintain a whirl giving a sufficiently long reaction time. A large proportion of the charged lead material will thus fall unaltered into the metal bath. The process does, however, afford some considerable advantages compared with earlier processes both from the point of view of heat economy and by the fact that finely-divided concentrate can be processed directly without previous sintering being necessary.

Another whirl or flash-smelting method is described in J of Metals, 1966, pp 1298–1302 where lead is recovered from lead sulphide by allowing lead sulphide to react with air in a shaft or a reverbatory furnace in accordance with the following formula: $PbS + O_2 \rightarrow Pb + SO_2$, a reaction which is sufficiently exothermic to keep the process going, provided that heated ari is used. Preheating of the air would not be necessary if pure oxygen were used but the gas supply would probably be insufficient in this case to maintain the required movements in the flash zone in the shaft. The method has not yet come into use and has only been applied on a pilot scale which indicates that it has not proved to be attractive enough for commercial use. The same method has, however, been applied on a large scale in the autogenous smelting of copper and nickel sulphides which apparently are more easily autogenously smelted and reduced due to the considerably greater quantity of heat generated in the reaction between oxygen and sulphide sulphur.

A disadvantage with the known slow rotating drum furnace is that it is not possible to purify economically the reduced lead with respect to As, Sb and Sn, for instance. Lead produced in slow rotating furnaces, shaft furnaces and reverbatory furnaces will then contain these impurities if these are present in the raw material. In the production of lead refined in this way these metals must therefore be oxidized so that they can be removed in the form of slag. This must normally be done in a separate apparatus in the conventional way where crude lead refining is effected by allowing Sn, Sb, and As to react with atmospheric oxygen to form oxides which float on the surface of the bath and which can be deslagged. Refining of this type can be carried out because of the fact that Sn, Sb and As have a greater affinity for oxygen than lead has.

In the above-mentioned slow rotating furnace method the said slagging can be effected by the use of an excess of air in the burner at a temperature of approx. 600–900° C. This is however extremely time-consuming. The factor which determines the speed and selectivity of the refining is the diffusion of impurities to the surface of the metal bath where oxidation, in this case, takes place. The reaction surface between the metal and the reaction gas in the slow rotating furnace is very small. Using oxygen gas in the oxidation in slow rotating furnaces has been tried but this led to the oxidation of large quantities of lead irrespective of whether the oxygen was blown on to the surface or into the bath itself.

Regarding the treatment of copper and/or nickel sulphides, processes have been developed in recent years using a so-called Kaldo converter which is a further development of the above-mentioned rotary furnaces. The Kaldo converter is characterized by its rapid rotation — up to 40 rpm — and by the fact that it is mounted on bearings so that it can rotate on an axis inclined to the plane of the horizontal. Such converters have long been in use in the steel industry. See Swedish Pat. No. 137 382 and 162 036. The patents describe methods of refining pig iron by blowing oxygen or oxygen-enriched air through a water-cooled lance on the the surface of the bath and at the same time rotating the converter.

In recent years, rapid rotary converters have thus come into use in the treatment of sulphidic material, e.g. in the production of copper and nickel. The method involves smelting and reducing with oxygen or oxygen-enriched air blown on to the surface of the bath by means of a lance. See, for example, 101 Annual Meeting AIME 1972 where Daniele and Jaquay describe methods of this kind. See also Swedish Pat. No. 369 734 which shows the treatment of copper slag with sulphide material to purify the slag and thereby recover its copper content. Swedish Pat. No. 355 603 also shows a method of producing copper by treating copper sulphide containing nickel. Previously known methods have not succeeded in obtaining an autogenous smelting of lead sulphide since the heat content of lead sulphide is low.

It has now suprisingly been shown that inclined rotating converters are very suitable for the autogenous production of crude lead by charging a warm, inclined, rotating converter with material containing lead sulphide, whereby the lead sulphide is smelted, the sulphur oxidized by the addition of oxygen or oxygen-enriched air and lead is obtained, and by feeding the lead sulphide and oxygen into the converter in such a way that the sulphur content of the lead bath is kept below 5%, preferably below 2%. The oxygen content of the gas or air fed in depends on the content of sulphide in the raw material and must normaly exceed approx. 40%.

BRIEF DESCRIPTION OF THE DRAWING

The drawing shows a conventional inclined top blown rotating converter used in the present invention.

In the smelting and reduction processes described above, considerable advantages are afforded in comparison with earlier known methods. By inclining the converter to the plane of the horizontal and by regulating the number of revolutions per minute the smelt can be lifted by frictional and centrifugal forces up the side of the converter to a maximum height after which it falls under the force of gravity as finely-divided drops of liquid. To obtain optimum conditions with respect to falling drops of liquid and inclination of 15°–30° to the plane of the horizontal and a rate of revolution between 10–60 rpm ought to be chosen. The converter diameter can vary from 0.5–10 m and is preferably 2–4.5 m. The converter must be driven during the above mentioned reduction and refining at a speed of 0.5–7 m/s measured at the inner periphery of the cylindrical part of the furnace. A preferred speed is 2–5 m/s. This will correspond to a 13–32 rpm for a converter with a diameter of 3 m. This movement of the smelt mass gives a thorough mixing of the charge so that the smelt becomes homogeneous with respect to its chemical composition at the same time as temperature gradients are rapidly evened out. By dispersing the smelt in the gas phase in this way, very rapid chemical reactions occur and equilibrium is established practically immediately. The unaltered sulphidic sulphur will again be found in the smelt bath and the quantity of sulphur naturally depends on the feeding rate of the concentrate and the quantity of oxygen blown into the converter. Experience has shown that the quantity of sulphidic sulphur in the smelt should not exceed 5% during the process, and preferably be below 2%. The lance is introduced to the converter so that the oxygen stream is directed against the surface of the bath, whereby the sulphidic sulphur in the smelt bath reacts with oxygen in the border line phase to the surface of the metal, primarily on the falling drops, and the gas phase.

By regulating the supplies of sulphide and oxygen with respect to each other and the degree of oxygen enrichment of the air injection, blast, the temperature can easily be controlled within a suitable interval, preferably 900 – 1200° C.

As shown in the FIGURE, oxygen or an oxygen-containing gas is passed into the top of the inclined rotating converter and contacts the surface of the bath.

Since lead sulphide is relatively easily volatilized it is important that the reaction with oxygen takes place quickly, but also that the temperature in the reaction does not get too high. It has, however, been demonstrated that the dust problems which always arise when finely-divided material is treated in metallurgical processes, can be avoided by using the present method. One factor making this possible is that the above-mentioned "rain" of drops of liquid smelt which is created in the rotation of the converter, probably contributes to wetting the charged materials so that the proportion of dust mechanically entrained in the exhaust gases is less than in other methods of lead refining.

This opens up the possibility of continually charging material which consists wholly or partially of very finely-grained particles, e.g. flotation concentrates, and allows considerable economic savings in the preparation of the charge.

In the reduction, slag-containing silicates are produced which consist mainly of lead oxide together with the zinc present in the raw material in the form of zinc oxide and the gangues comprising the lead concentrates. By further supplying sulphides such as pyrites and lead sulphide the lead content can be reduced from approx. 60% to approx. 10%. A further reduction in the lead content of the slag can be brought about by the addition of coal and further heating if needed. When the lead content falls to below approx. 5% the zinc content is defumed and collected by some suitable method separately.

As the reaction $PbS + O_2 \rightarrow Pb + SO_2$ generates sufficient heat during the process it is not necessary to supply heat from external sources. This is done only at the start of the process in order to reach the flash point of the reduction, approx. 800° C, and in the above-mentioned reduction of the lead content of the slag.

EXAMPLE

In a test carried out in accordance with the present invention a top blown rotating converter with a total volume of 3 $m^3$ and an effective volume of 1 $m^3$ was used. The converter was supplied with the usual auxiliary equipment, amongst which can be mentioned charging bins for lead concentrates, oxidic intermediate products containing lead, soda and a slagging agent. The bins were fitted with feeder screws for the accurate feeding of the respective materials. Lead concentrate was fed from a bin via a screw to an injector and blown into the converter together with a controlled quantity of air. The feeder screw for the slagging agent and the soda also led into the injector so that they could be fed into the converter together with the lead concentrate.

The lead concentrate which had the following analysis: 72% Pb, 13% S, 3.5% Zn and 5% SiO, was fed into the converter pre-heated by means of a burner to approx. 800° C, at a rate of 50 kg/min together with a stochiometric quantity of oxygen. The oxygen gas was blown in together with air through the injector during the feeding of concentrate and contained 58% oxygen, the remainder consisting mainly of nitrogen.

Under the given conditions the smelting and reduction of lead were effected autogenously. The temperature was approx. 1000° C and the sulphur content of the smelt was kept at approx. 2%.

Altogether 4000 kg concentrate were fed into the converter in this test. Dust which left the converter entrained in the exhaust gases comprises only 8% (or 321 kg) of the quantity of concentrate supplied to the converter and consisted mainly of PbO and $PbSO_4$. This dust was returned to the converter. The quantity of slag was approx. 820 kg, consisting of 7 – 8% zinc and 50% lead. $SiO_2$ accounted for the remainder and was present as gangue in the concentrate supplied to the converter. To reduce further the sulphur content in the metal bath an additional blast of oxygen gas was supplied whilst rotating the converter at a speed of 25 rpm for approx. 20 min. This caused the sulphur content to fall to 0.1%. The lead content of the slag was then approx. 60% in the form of lead oxide. At this stge the slag flowed easily on account of its high lead oxide content. To reduce the lead content of the slag a reduction was effected by the addition of lead concentrate. Lead was then reduced out in accordance with the formula: $2\ PbO + PbS \rightarrow 3\ Pb + SO_2$. The temperature was approx. 1100° C. By decreasing the PbO content of the slag to a lead content of approx. 10%, the slag became very viscous. Soda was therefore added at the rate of 12.5 kg per ton lead concentrate supplied together with the lead concentrate in the above reaction. This created a slag which flowed very easily and, in addition, the soda contributed to keeping the sulphur content of the metal without any difficulty at approx. 0.15%. To effect the smelting of the soda, the slag was heated by a burner fitted to the furnace. The time required for this was approx. 20 min.

Coke was now added to decrease the lead content of the slag even further bringing the lead content down to approx. 5%. The lead content could be decreased from 10% to 5% in 25 min.

Further decreasing the PbO in the slag causes zinc to begin to be reduced and, on account of its volatility, to be fumed off.

A very important factor in the autogenous smelting is the quantity of oxygen supplied in relation to the quantity of concentrate fed in. If the quantity of oxygen gas is less than the stoichiometric, the amount of dust increases considerably because of the fact that the smelt contains charged PbS which is very volatile. Experiments with various quantities of oxygen gas gave the following results.

| No. | mol $O_2$ / mol PbS | Quantity of Pb-concentrate (kg) | Temp.° C | Quantity of dust (kg) |
|---|---|---|---|---|
| 1 | 0.4 | 4000 | 1110 | 1862 |
| 2 | 0.8 | 4000 | 1180 | 1120 |
| 3 | 0.95 | 4000 | 1200 | 571 |
| 4 | 0.80 | 4000 | 1000 | 321 |
| 5 | 1.2 | 4000 | 1100 | 310 |

From the results of tests 2 and 4 it is apparent that the temperature in autogenous smelting also affects the quantity of dust. This is strongly accentuated if the quantity of oxygen relative to lead at the same time is low.

Experimental experience has shown that the ratio between the quantity in mol of oxygen supplied and the quantity in mol of PbS should lie between 0.8–1.4, preferably 1.0–1.2.

It has also proved possible to effect zinc elimination in a "Kaldo converter" by reducing the lead content further with coke and additional heat, whereby the reduction potential is sufficiently high for a considerable reduction of zinc compounds to metallic zinc. Zinc is volatile at these temperatures and will therefore be fumed off with the exhaust gases.

In the present case, 164 kg coke was added in the execution of the process. The slag was treated in accordance with the present method and a quantity of dust, approx. 8% of the material supplied, was obtained. The dust was returned until its Pb-content in the slag had fallen to approx. 5% as the dust then consisted mainly of PbO and $PbSO_4$. When the Pb-content of the slag fell below 5%, the ZnO content of the slag began to be reduced to metallic Zn which was volatilized. The dust thereby obtained was removed from the gas purification system and was not returned to the process. The dust can be treated separately to recover the zinc. The lead produced can be further refined in the conventional way or directly offered for sale.

I claim:

1. The method of autogenous production of crude lead from materials containing lead sulfide comprising the steps of rotating at 10–60 r.p.m. a pre-heated top blown rotary converter on an axis inclined to the horizontal plane at a speed of 0.5–7 m/s measured at the inner periphery of the cylindrical part of the converter, charging the lead sulfide containing materials into said rotating converter and simultaneously, introducing oxygen or oxygen-enriched air into said furnace so that the sulphur in the charge is combusted and the heat thereby obtained is caused to generate a smelt of lead and a lead containing slag, said smelt of lead and said lead containing slag by means of the frictional force induced by the rotational speed being lifted up along said inner periphery of the converter to a level at which smelt falls down as finely-divided drops of liquid, treating said smelt of lead and said lead containing salg with reducing agents so that lead content of said slag is decreased not to esceed 10%, and thereafter tapping slag and crude lead from the furnace; said crude lead having a sulfur content not exceeding 2%.

2. The method of claim 2, wherein oxygen or oxygen-enriched air is further introduced before tapping, but after lead sulfide charging is terminated, whereby the sulfide content in the smelt is further decreased.

3. The method according to claim 1, in which the quantity in mol of oxygen supplied relative to the quantity in mol of lead sulfide is between 0.8 and 1.4.

4. The method according to claim 3, in which the ratio is 1.0–1.2.

5. The method according to claim 1, in which the oxygen content of the gas supplied is greater than 40%.

6. The method according to claim 1, in which dust obtained in the process is returned to the converter.

7. The method of claim 1 wherein the reducing agents are selected from the group consisting of metal sulfides and carbon-containing fuels.

8. The method of claim 7 wherein the carbon-containing fuel is coke.

9. The method according to claim 1, in which the top blown rotary converter is pre-heated to a temperature over 800° C before charging said lead sulfide-containing materials.

10. The method according to claim 1, in which the temperature during the smelting is maintained between 900° and 1200° C.

11. The method of claim 1, wherein said speed is 2–5 m/s.

* * * * *